US008460429B2

(12) United States Patent
Ratchev et al.

(10) Patent No.: US 8,460,429 B2
(45) Date of Patent: Jun. 11, 2013

(54) PRODUCTION OF NICKEL

(75) Inventors: Ivan Ratchev, Jesmond (AU); Gregory David Rigby, Charlestown (AU); René Ignacio Olivares, Adamstown Heights (AU); Grant Caffery, Lawley (AU)

(73) Assignee: BHP Billiton Innovation Pty Ltd, Melbourne, Victoria (AU)

( * ) Notice: Subject to any disclaimer, the term of this patent is extended or adjusted under 35 U.S.C. 154(b) by 0 days.

(21) Appl. No.: 12/742,828

(22) PCT Filed: Feb. 12, 2009

(86) PCT No.: PCT/AU2009/000167

§ 371 (c)(1),
(2), (4) Date: Dec. 16, 2010

(87) PCT Pub. No.: WO2009/100495

PCT Pub. Date: Aug. 20, 2009

(65) Prior Publication Data

US 2011/0118100 A1 May 19, 2011

(30) Foreign Application Priority Data

Feb. 12, 2008 (AU) ..... 2008900653

(51) Int. Cl.
*C22B 7/04* (2006.01)
*C22B 23/00* (2006.01)

(52) U.S. Cl.
USPC ..... 75/629; 65/19

(58) Field of Classification Search
USPC ..... 75/629; 65/19
See application file for complete search history.

(56) References Cited

U.S. PATENT DOCUMENTS

| | | | | |
|---|---|---|---|---|
| 2,772,961 | A | 12/1956 | Seger et al. | |
| 3,769,002 | A | 10/1973 | O'Neill et al. | |
| 3,854,936 | A | 12/1974 | Hunter et al. | |
| 2008/0011126 | A1 * | 1/2008 | Duarte et al. | 75/430 |
| 2008/0016986 | A1 | 1/2008 | Liu et al. | |

FOREIGN PATENT DOCUMENTS

| | | |
|---|---|---|
| JP | 05-295468 | 11/1993 |
| JP | 08-0350222 | 2/1996 |
| WO | WO 2008/022381 | 2/2008 |

OTHER PUBLICATIONS

Machine translation of JP 08-035022 published Feb. 6, 1996.*

* cited by examiner

*Primary Examiner* — George Wyszomierski
*Assistant Examiner* — Tima M McGuthry Banks
(74) *Attorney, Agent, or Firm* — Brinks Hofer Gilson & Lione; G. Peter Nichols

(57) ABSTRACT

A method of smelting a nickel intermediate product in a smelter that contains a molten bath of metal and slag to produce a nickel product, the method comprising supplying the nickel intermediate product and a solid reductant to the smelter and smelting the nickel intermediate product to produce molten nickel, and controlling the chemistry of the slag so that the slag has (a) a high solubility for elements and compounds in the nickel intermediate product that are regarded as contaminants in the nickel product and (b) a liquidus temperature in the range of 1300-1700 C.

24 Claims, 11 Drawing Sheets

PRODUCTION OF NICKEL

This application claims priority to PCT Application Ser. No. PCT/AU2009/000167 filed Feb. 12, 2009 published in English on Aug. 20, 2009as PCT WO 2009/100495; and to Australian Application No. 2008900653 filed Feb. 12, 2008, the entire contents of each are incorporated herein by reference.

FIELD OF THE INVENTION

The present invention relates to the production of nickel by smelting a nickel intermediate product.

The present invention particularly relates to controlling the chemistry of a slag phase formed during smelting of the nickel intermediate product, so as to facilitate partitioning of nickel and contaminants between the molten metal and the molten slag.

The term "nickel" or "nickel product" is understood herein to include nickel on its own and alloys that contain nickel and other metals, such as ferronickel.

The term "nickel intermediate product" is understood herein to mean a nickel-containing product that is produced by hydrometallurgically processing a nickel-containing ore or a concentrate of the ore, preferably followed by drying and/or calcination. The hydrometallurgical processing may include any one or more of atmospheric acid leaching, pressure acid leaching, and heap leaching under acidic conditions.

BACKGROUND OF THE INVENTION

Nickel is an important industrial metal and end-uses of the metal include stainless steels, high temperature alloys such as Inconel (Registered Trade Mark), and catalysts.

The nickel-containing ore may be any ore, such as an oxide ore, i.e. a laterite ore, or a sulphide ore.

Nickel intermediate products include, by way of example, nickel carbonates as produced by the Caron process at the Yabulu refinery of the applicant.

Nickel intermediate products also include, by way of example, nickel hydroxide products, or nickel oxide products.

The present invention relates particularly, although by no means exclusively, to the production of nickel from a nickel intermediate product in the form of a nickel hydroxide product, that is produced by hydrometallurgically processing a nickel-containing ore or a concentrate of the ore. Preferably, the nickel hydroxide product is subjected to further processing comprising drying and/or calcination to remove water prior to use.

The term "nickel hydroxide product" is understood herein to mean any product that contains nickel hydroxide that is produced by hydrometallurgically processing a nickel-containing ore or a concentrate of the ore and includes products that also contain other compounds such as any one or more of iron hydroxides, magnesium sulphates, calcium sulphates, manganese oxides and/or hydroxides, cobalt hydroxides, alumina, silica, and sodium sulphates and trace amounts of other elements.

Typically, when produced by hydrometallurgical processing, the nickel hydroxide product is in the form of a paste or a slurry with a water (i.e. moisture) content of 30-75 wt %. It also typically includes sulphur when the product is derived from a hydrometallurgical process which included sulphuric acid leaching. In any given situation, the water content depends on a range of factors, including the particle size distribution of the solid components, the degree of mechanical filtration or de-watering, and evaporation. Prior to its use in the process of the present invention, it is preferable to substantially remove free water and water of crystalisation, in addition to any sulphur, from the nickel hydroxide product.

The nickel hydroxide product may be produced by (a) any suitable hydrometallurgical process (such as pressure acid leaching, heap leaching under acidic conditions, and atmospheric acid leaching—or a combination) that brings nickel into an aqueous solution and (b) precipitating nickel hydroxide from solution for example using compounds such as MgO, CaO, $CaCO_3$, and $Na_2CO_3$.

One particular example of a hydrometallurgical process is a process that comprises extracting nickel and iron from an aqueous solution onto an ion exchange resin, stripping the nickel and iron from the resin with an acid and forming another aqueous solution, and then precipitating nickel and iron as a nickel iron hydroxide product.

SUMMARY OF THE INVENTION

According to the present invention there is provided a method of smelting a nickel intermediate product as described above in a smelter that contains a molten bath of metal and slag to produce a nickel product, the method comprising supplying the nickel intermediate product and a solid reductant to the smelter and smelting the nickel intermediate product to produce molten nickel, and controlling the chemistry of the slag so that the slag has (a) a high solubility for elements and compounds in the nickel intermediate product that are regarded as contaminants in the nickel product and (b) a liquidus temperature in the range of 1300-1700° C.

The present invention also provides a nickel product produced by the above-described method.

The present invention further provides a molten slag produced in the smelting step in the above-described method.

The basis of the above-described selection of the slag chemistry (solubility and liquidus temperature) is to facilitate partitioning, i.e. separating, nickel into the molten metal and contaminants into molten slag to an extent required in any given situation.

The term "contaminants" in the context of a nickel product is understood herein to include any one or more of magnesium, calcium, cobalt, copper, manganese, silicon, sulfur, phosphorus, and aluminium in elemental form and as compounds, such as oxides, and any other elements and compounds that are regarded as contaminants in the nickel product, when present at all or when present at concentrations above threshold concentrations.

The term "nickel product" is understood herein to include nickel and nickel alloys, such as ferronickel alloys.

The term "molten bath" is understood herein to include baths of metal and slag that are entirely molten and baths that have molten metal and slag and some solids in the bath, for example, as a result of precipitation in the bath during the course of a smelting run.

The slag has a liquidus temperature in the range of 1300-1700° C. Preferably the method comprises controlling the slag chemistry so that the slag has a liquidus temperature in the range of 1300-1650° C. such as between 1350° C. to 1550° C. In one embodiment, the liquidus temperature is in the range of 1400-1600° C. In another embodiment, the liquidus temperature is in the range of 1500-1550° C.

Typically, the method comprises controlling the slag chemistry so that the slag has a liquidus temperature in the range of 1400-1520° C.

The composition of the nickel intermediate product may contribute to form a slag having a required slag chemistry.

However, the method may comprise controlling the slag chemistry by supplying one or more than one flux as required to the smelter to form the slag with a required slag chemistry. By way of example, the flux may comprise any one or more of CaO, $Al_2O_3$, $SiO_2$ and MgO.

Preferably, the flux comprises a CaO—$Al_2O_3$ based composition. The flux composition may additionally include $SiO_2$ and/or MgO. The applicant has found that a CaO—$Al_2O_3$ based, as opposed to a CaO—$SiO_2$ based, flux enables an enhanced reduction rate of nickel oxides in the slag, thereby improving productivity. Moreover, a lower steady state nickel oxide content in the slag can be maintained and thereby improve nickel recovery.

The applicant has found that the following pseudo-tertiary, pseudo-quaternary, and pseudo-quinary systems as slag chemistries that are suitable for the present invention.

1. CaO—MgO—$Al_2O_3$
2. CaO—$SiO_2$—MgO—$Al_2O_3$
3. CaO—$SiO_2$—MgO—$Al_2O_3$—MnO

More particularly, the applicant has identified compositions within the above systems that have liquidus temperatures in the range of 1300-1700° C. and a high solubility for contaminants, such as MgO, CaO, and $SiO_2$.

The $Al_2O_3$ concentration may be as high as 40 to 55 wt. % of the total weight of slag in the smelter. In an embodiment, the $Al_2O_3$ concentration is up to 25 wt. % of the total weight of slag.

Preferably the method comprises controlling the slag chemistry so that the slag basicity, as a ratio of $$\frac{(CaO + MgO)}{(SiO_2 + Al_2O_3)},$$

is in the range of 0.5:1 to 1.7:1.

In one embodiment, the basicity ratio is in the range of 0.5:1 to 1.5:1.

The above slag chemistries may comprise other constituents, such as FeO, $Fe_2O_3$ and MnO depending on the composition of the nickel intermediate products and the fluxes required for the method.

In order to minimise operating costs, the fluxes are preferably derived from inexpensive sources such as burnt lime, burnt dolomite and bauxite. Readily available commercial compositions could also be used. The fluxes may be added using any suitable method in the art.

In a situation in which the slag is a CaO—$SiO_2$—MgO—$Al_2O_3$ system with an $Al_2O_3$ concentration of 5 wt. %, preferably the slag comprises CaO in a range of 35-55 wt. % and $SiO_2$ in a range of 35-50 wt. %. More preferably, the slag comprises CaO in a range of 45-55 wt. % and $SiO_2$ in a range of 35-45 wt. %.

In a situation in which the slag is a CaO—$SiO_2$—MgO—$Al_2O_3$ system with an $Al_2O_3$ concentration of 10 wt. %, preferably the slag comprises CaO in a range of 35-55 wt. % and $SiO_2$ in a range of 30-50 wt. %. More preferably, the slag comprises CaO in a range of 45-55 wt. % and $SiO_2$ in a range of 30-45 wt. %.

In a situation in which the slag is a CaO—$SiO_2$—MgO—$Al_2O_3$ system with an $Al_2O_3$ concentration of 15 wt. %, preferably the slag comprises CaO in a range of 35-52 wt. % and $SiO_2$ in a range of 28-45 wt. %. More preferably, the slag comprises CaO in a range of 35-45 wt. % and $SiO_2$ in a range of 30-40 wt. %.

In a situation in which the slag is a CaO—$SiO_2$—MgO—$Al_2O_3$ system with an $Al_2O_3$ concentration of 20 wt. %, preferably the slag comprises CaO in a range of 30-55 wt. % and $SiO_2$ in a range of 15-40 wt. %. More preferably, the slag comprises CaO in a range of 35-45 wt. % and $SiO_2$ in a range of 35-30 wt. %.

In a situation in which the slag is a CaO—$SiO_2$—MgO—$Al_2O_3$ system with an $Al_2O_3$ concentration of 25 wt. %, preferably the slag comprises CaO in a range of 35-60 wt. % and $SiO_2$ in a range of 10-25 wt. %. More preferably, the slag comprises CaO in a range of 25-50 wt. % and $SiO_2$ in a range of 15-25 wt. %.

In the situation where the slag is a CaO—MgO—$Al_2O_3$ system, the slag can comprise a MgO content up to 15%, and a CaO to $Al_2O_3$ ratio of 1.7 to 0.5, preferably 1.5 to 0.6.

Preferably the method comprises controlling the slag chemistry so that the slag has as high as possible sulphide capacity.

More preferably the method comprises controlling the slag chemistry so that the slag has a sulphide capacity of at least $8\times10^{-4}$, where sulphide capacity, $C_S$, is defined (Verin Deutscher Eisenhuttenleute, (1995)_, Slag Atlas, $2^{nd}$ Ed., Verlag Stahleisen GmbH, Dusseldorf, pp 258) as:

$$C_S = (\text{wt \% } S)\sqrt{\frac{P_{O2}}{P_{S2}}},$$

and $P_{O2}$ and $P_{S2}$ are the partial pressures of oxygen and sulphur.

The conditions of the smelting step in the smelter may be selected to (a) maximise the amount of nickel in the molten metal, (b) minimise the amount of nickel in the slag, and (c) minimise the amount of nickel in an off-gas generated in the smelting step. This is a particularly important objective when there is a high commercial value for nickel and a high cost of removing nickel in downstream processing of slag and dust.

Alternatively, the conditions of the smelting step may be selected to be more flexible with respect to the relative amounts of nickel in the molten metal and the slag. For example, the fact that nickel reduces more readily than other metals, means that it may be preferable under certain circumstances to operate under less reducing conditions that result in higher amounts (for example, up to 1 wt. %) of nickel being retained in the slag than would be the case when operating under more reducing conditions. The advantage of operating under less reducing conditions is that there will be lower amounts of other reduced metals, such as Fe and Mn, in the molten metal discharged from the smelter and hence lower costs associated with downstream processing of the molten metal to isolate nickel from the other metals.

Typically, the nickel intermediate product contains 20-50 wt. % nickel, on a dry basis.

The nickel intermediate product may contain 20-75 wt. % free water and the product may be in the form of a paste or a slurry when formed.

Typically, the nickel intermediate product contains 35-75 wt. % free water and the product is in the form of a paste or a slurry.

The nickel intermediate product may be a nickel hydroxide product that is produced by hydrometallurgically processing a nickel-containing ore or a concentrate of the ore.

The nickel hydroxide product may be an iron-containing nickel hydroxide product.

The iron-containing nickel hydroxide product may have a high concentration of iron, i.e. at least 3 wt. % iron.

The reductant may be any suitable carbonaceous material. Suitable carbonaceous materials include char, coke, and coal.

Preferably the method comprises periodically or continuously discharging molten metal from the smelter.

Preferably the method comprises generating heat within the smelter to maintain the bath of metal and slag in a molten state. The heat may be generated by electrical discharge heating in the case of an electric arc furnace or by combustion of carbon, CO or $H_2$ in the case of other types of smelters.

Preferably the method comprises treating an off-gas produced in the smelting step and removing nickel and/or sulphur-based acidic components from the off-gas.

Preferably the method comprises drying and calcining the nickel intermediate product prior to supplying the product to the smelter. The drying and calcining steps are particularly applicable when the nickel intermediate product is supplied as a paste or a slurry.

Preferably the drying step at least substantially removes free water from the nickel intermediate product.

Preferably the drying step comprises drying the nickel intermediate product at a temperature up to 120° C.

Preferably the drying step comprises drying the nickel intermediate product at a temperature of at least 100° C.

The drying step may be carried out in any suitable apparatus.

Preferably the calcining step comprises calcining the nickel intermediate product at a temperature of up to 1000° C. to remove the water of crystalisation. The removal of water of crystallisation has the advantages of minimising higher gas handling requirements in the smelting stage. The actual calcination temperature selected will depend on the nature of the nickel intermediate product, including its chemistry and the quantity being calcined. Typically, however, an acceptable rate of removal of water of crystallisation is achievable once a calcination temperature of 800° C. is reached. At industrial scale, the rate of removal of free water and water of crystallisation is also influenced by factors such as volume of swept air, heat and mass transfer area of the equipment and surface area and porosity of the nickel intermediate product. The minimum temperature required to remove water of crystallisation may be around 400° C.

Typically, the smelter is an electric arc furnace or another molten bath-based smelter. The nickel intermediate product, the solid reductant, and the flux or fluxes may be supplied to the smelter in any suitable physical form (for example, as fines and pellets) and by any suitable supply options (for example, by gravity feed and via injection lances).

However, preferably the smelter is a DC furnace, such as a DC electric arc furnace. A DC furnace has the advantage that the nickel intermediate product, reductant and/or flux may be added to the furnace as fines without the need for prior agglomeration, due to the relatively quiescent conditions inside a DC furnace during operation. By comparison, the interior of an AC furnace is relatively violent during operation, meaning lower entrainment of the fines within the molten phase and higher carry over dust, both of which can result in lower nickel recovery.

In situations where the nickel intermediate product contains sulphur in amounts that may be an issue in the nickel product or in the smelter, preferably the method comprises treating the dried nickel intermediate product to remove sulphur from the product and producing a treated product, that typically contains nickel in the form of NiO, that becomes a feed material for the smelter.

Preferably the sulphur treatment step at least substantially removes sulphur from the nickel intermediate product.

Preferably the sulphur treatment step comprises calcining the nickel intermediate product under oxidising conditions at a temperature in a range of 800-1300° C. Such calcination conditions are sufficient to also remove water of crystallisation.

Preferably the calcining step at least substantially removes sulphur from the nickel intermediate product as $SO_2$ and $SO_3$ gas.

Typically, the calcining step is carried out in a calciner and the oxidising conditions are produced by supplying air or an oxygen-enriched air to the calciner.

The calcining step may be carried out in any suitable calciner, such as a flash calciner, a kiln (eg a rotary kiln), a multi-hearth furnace, and a shaft furnace.

The drying step and the calcining step may be carried out in separate unit operations or in a single unit operation having different temperature zones for drying and thereafter calcining the nickel intermediate product. One factor that is relevant to the selection of a single unit operation or a multiple unit operation is dust carry-over. Preferably the drying and calcining steps operate with minimal dust carry-over. This is a particularly important issue given the hazardous nature of NiO produced in the calcining step.

Preferably the method comprises refining the molten metal from the smelter to tailor the composition of the nickel product to suit an end-use application of the product, such as in the production of a stainless steel.

Typically, the refining step comprises at least partially removing any one or more of carbon, silicon and sulphur from the molten metal from the smelter.

EXAMPLES AND DRAWINGS

Further features and advantages of the invention will become more readily apparent from a consideration of the following Examples and accompanying drawings, of which:

Figure 9:
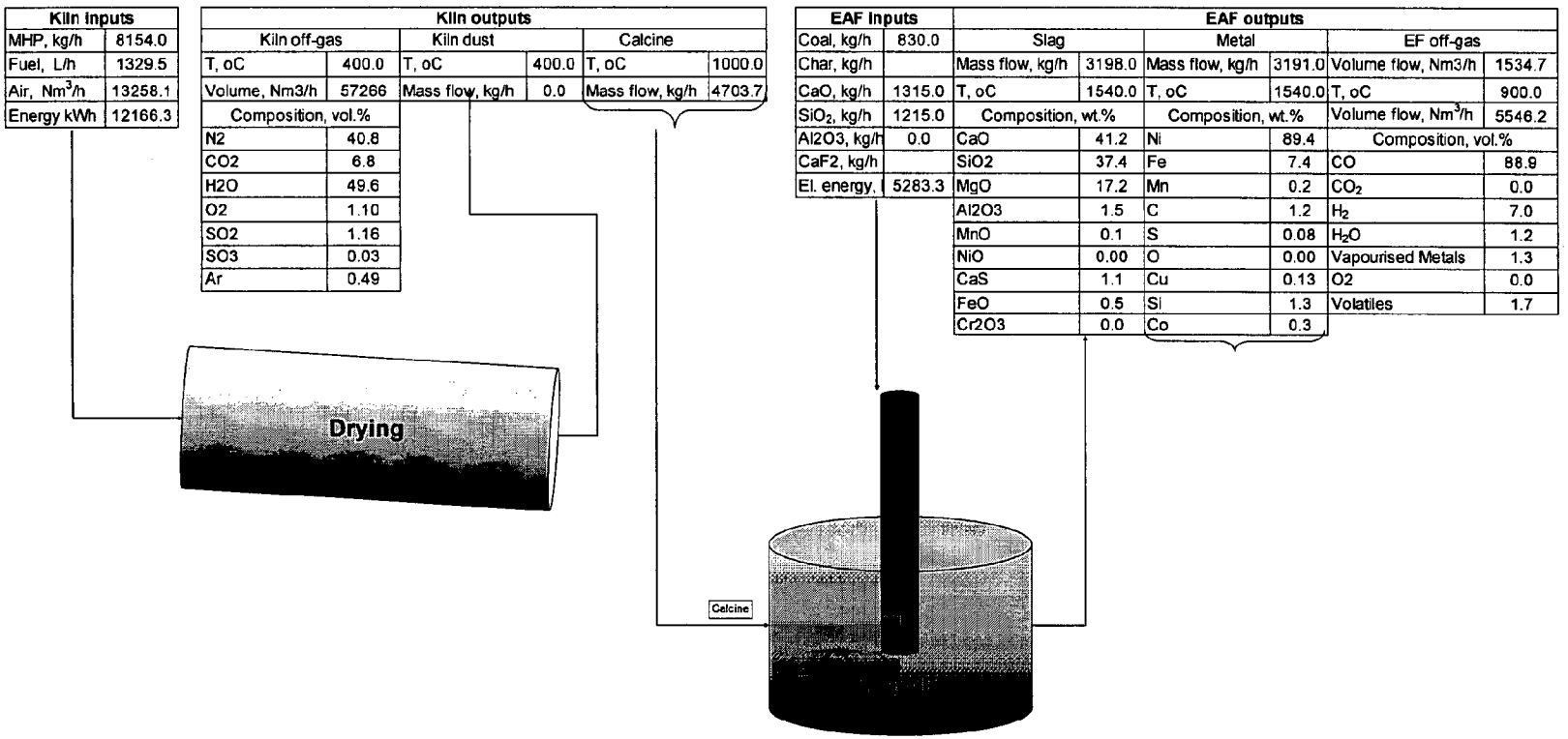
Figure 10:
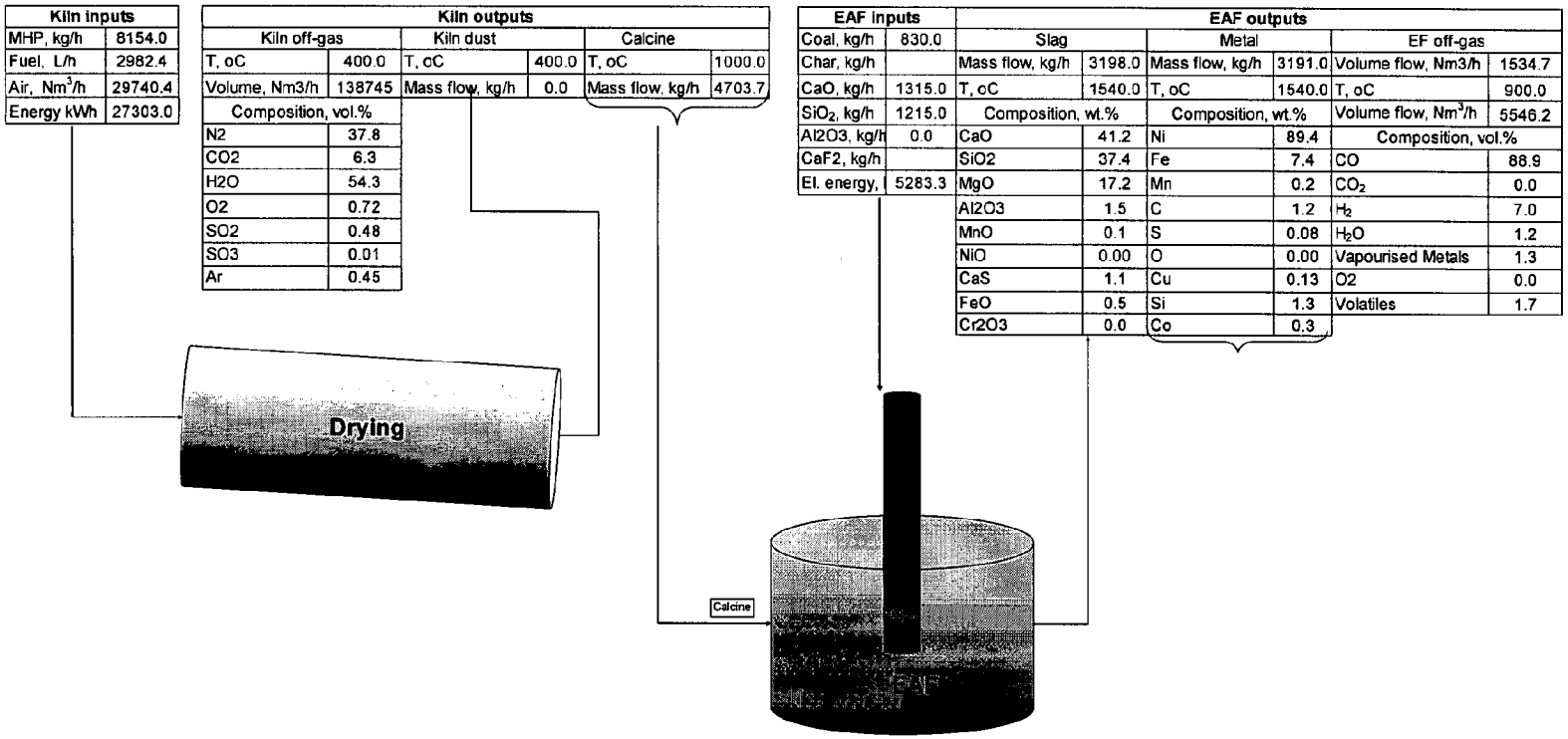
Figure 11:
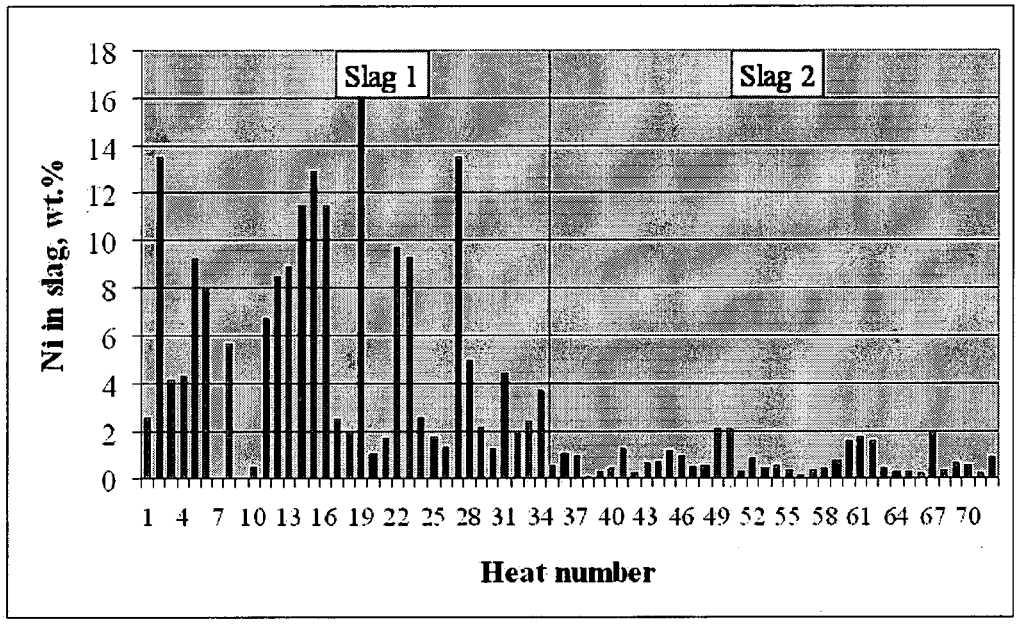

FIGS. 7-10 summarise the results of 4 different runs of a model relating to the method of the present invention developed by the applicant; and FIG. 11 is a plot of wt. % nickel in slag versus Heat Number for a number of smelting operations utilising two slag compositions.

As is described above, the applicant has identified that the following pseudo-tertiary, pseudo-quaternary, and pseudo-quinary systems are slag chemistries that are suitable for the present invention.

1. $CaO—MgO—Al_2O_3$
2. $CaO—SiO_2—MgO—Al_2O_3$
3. $CaO—SiO_2—MgO—Al_2O_3—MnO$

FIGS. 1 to 6 are based on phase diagrams from the Slag Atlas, 2nd Edition, (1995), Edited by Verein Deutscher Eisenhuttenleute (VDEh), Published by Verlag Stahleisen GmbH, D-Dusseldorf.

FIGS. 1-5 are ternary phase diagrams for $CaO—SiO_2—MgO$ in the $CaO—SiO_2—MgO—Al_2O_3$ system for $Al_2O_3$ concentrations of 5 wt %, 10 wt. %, 15 wt. %, 20 wt %, and 25 wt % respectively. Each of the phase diagrams includes a marked region that identifies a zone in the system representing a preferred slag composition range, suitable for use in the present invention, that has liquidus temperatures in the range of 1300-1700° C. and has a high solubility for contaminants, in this instance MgO, $SiO_2$, S and CaO in accordance with the present invention. Within each preferred slag composition zone is a more preferred slag composition region, also marked on each phase diagram.

Figure 1:
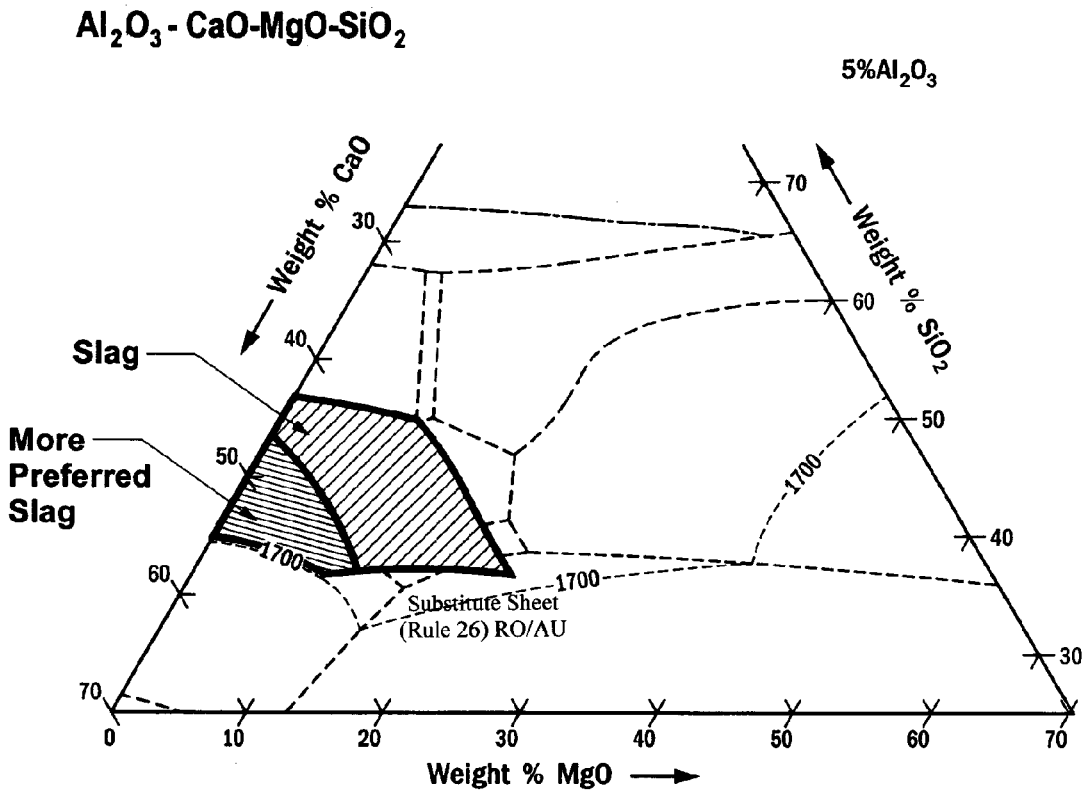
FIGS. 1-5 are ternary phase diagrams for $CaO—SiO_2—MgO$ showing preferred slag compositions in a $CaO—SiO_2—MgO—Al_2O_3$ pseudo-quaternary system for $Al_2O_3$ concentrations of 5 wt %, 10 wt. %, 15 wt. %, 20 wt %, and 25 wt % respectively.

FIG. 1 is a ternary phase diagram for $CaO—SiO_2—MgO$ in the $CaO—SiO_2—MgO—Al_2O_3$ system at a $Al_2O_3$ concentration of 5 wt. %, preferably the slag comprises CaO in a range of 35-55 wt. % and $SiO_2$ in a range of 35-50 wt. %. More preferably, the slag comprises CaO in a range of 45-55 wt. % and $SiO_2$ in a range of 35-45 wt. %.

Figure 2:
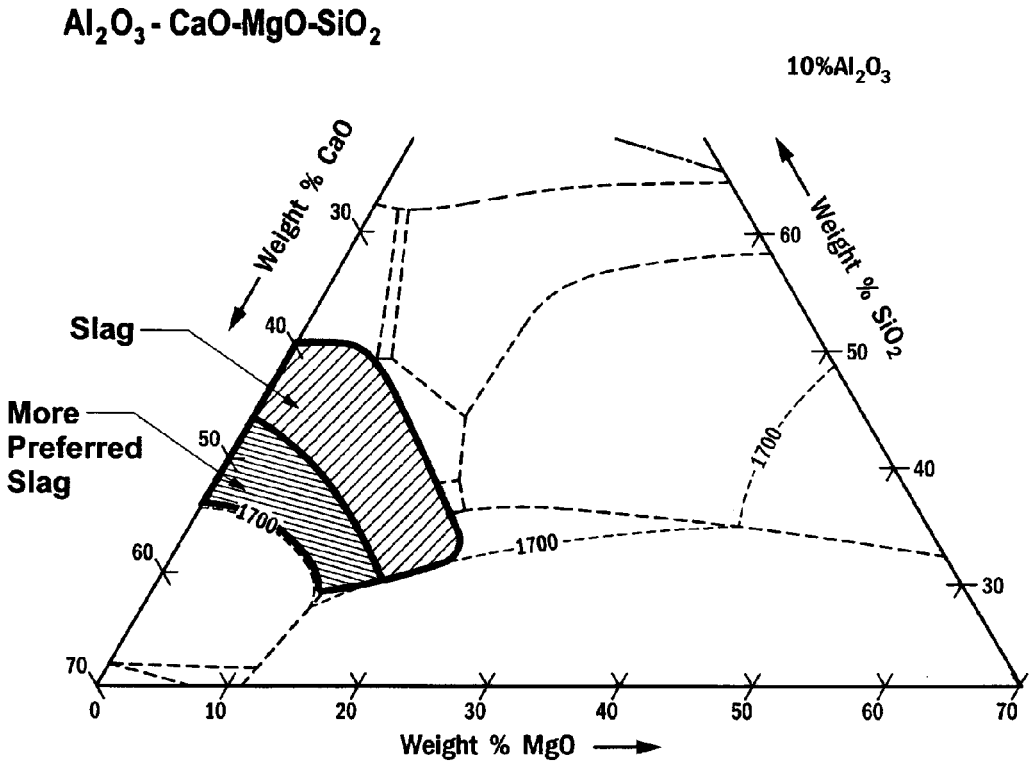

FIG. 2 is a ternary phase diagram for $CaO—SiO_2—MgO$ in the $CaO—SiO_2—MgO—Al_2O_3$ system at a $Al_2O_3$ concentration of 10 wt. %, preferably the slag comprises CaO in a range of 35-55 wt. % and $SiO_2$ in a range of 30-50 wt. %. More preferably, the slag comprises CaO in a range of 45-55 wt. % and $SiO_2$ in a range of 30-45 wt. %.

Figure 3:
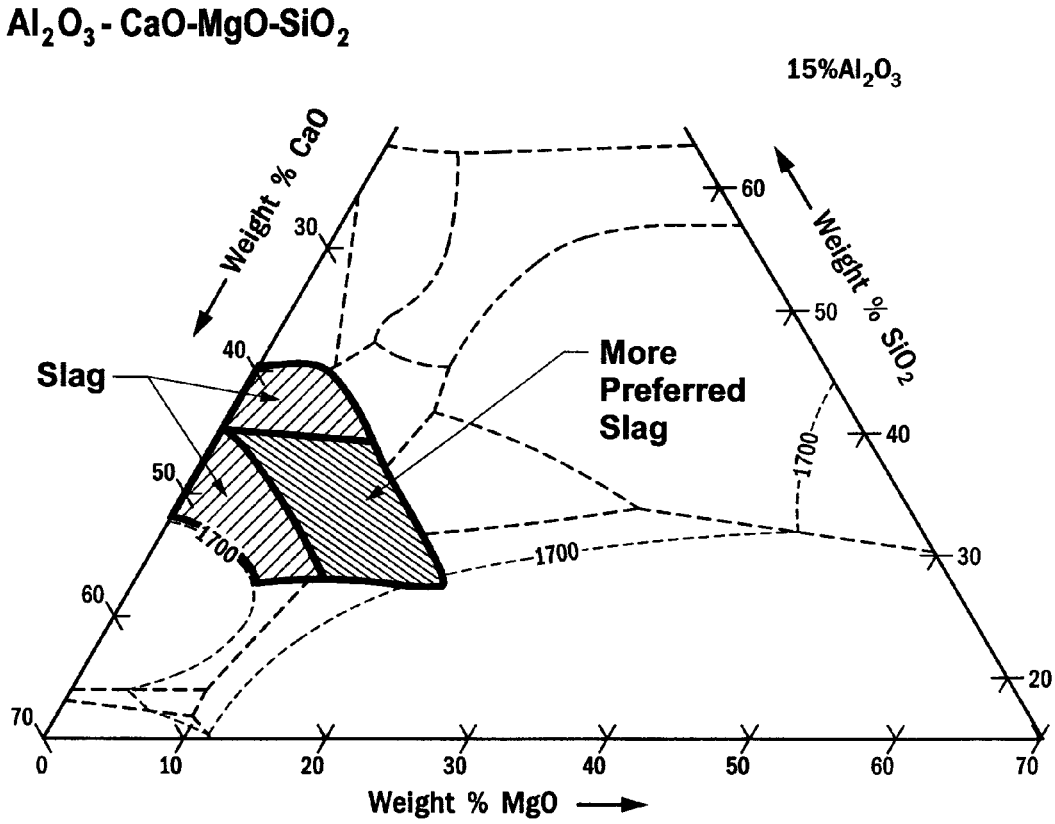

FIG. 3 is a ternary phase diagram for $CaO—SiO_2—MgO$ in the $CaO—SiO_2—MgO—Al_2O_3$ system at a $Al_2O_3$ concentration of 15 wt. %, preferably the slag comprises CaO in a range of 35-52 wt. % and $SiO_2$ in a range of 28-45 wt. %. More preferably, the slag comprises CaO in a range of 35-45 wt. % and $SiO_2$ in a range of 30-40 wt. %.

Figure 4:
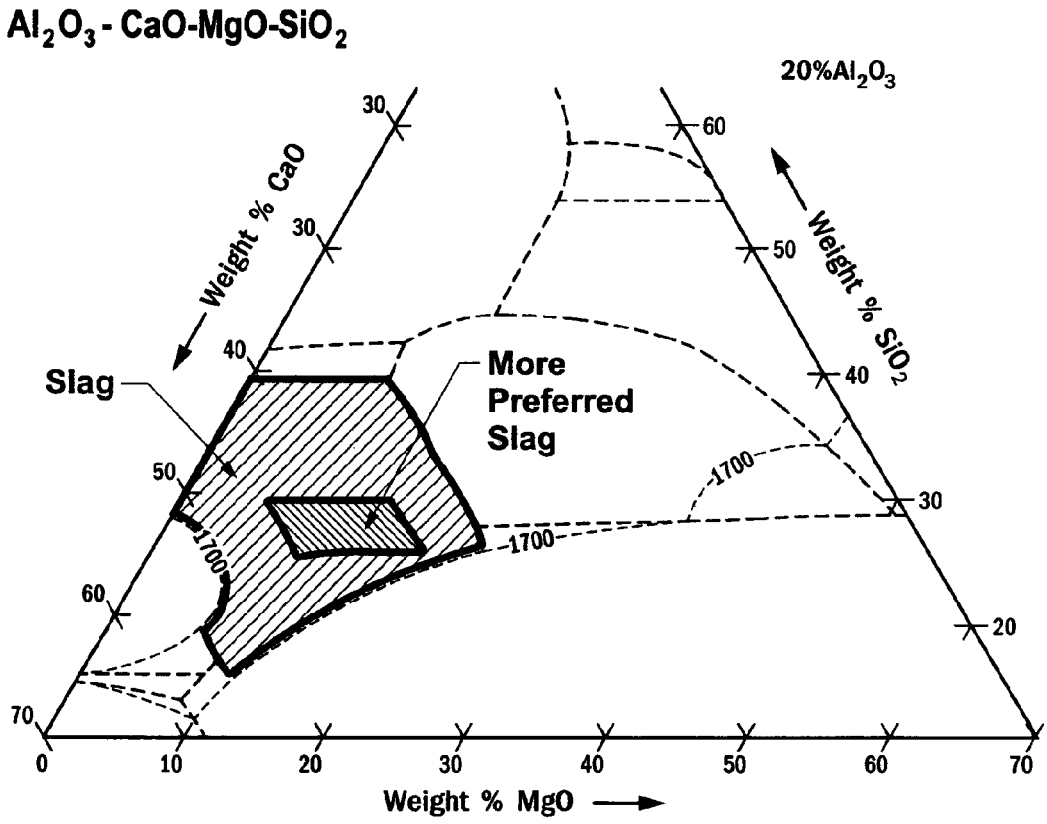

FIG. 4 is a ternary phase diagram for $CaO—SiO_2—MgO$ in the $CaO—SiO_2—MgO—Al_2O_3$ system at a $Al_2O_3$ concentration of 20 wt. %, preferably the slag comprises CaO in a range of 30-55 wt. % and $SiO_2$ in a range of 15-40 wt. %. More preferably, the slag comprises CaO in a range of 35-45 wt. % and $SiO_2$ in a range of 25-30 wt. %.

Figure 5:
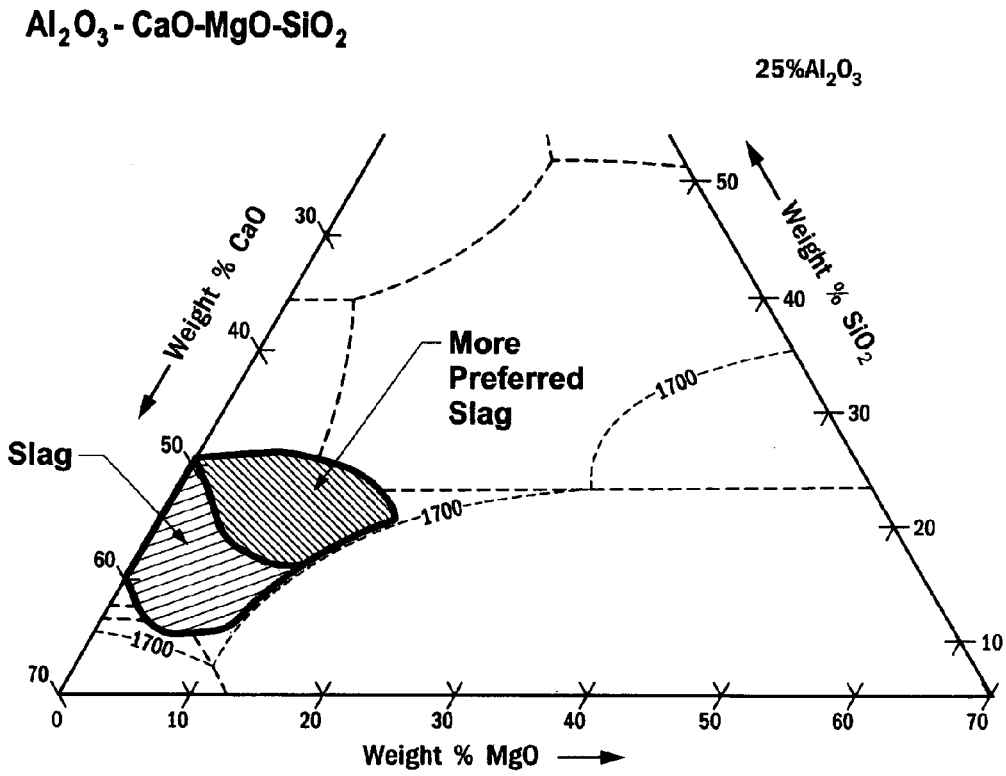

FIG. 5 is a ternary phase diagram for $CaO—SiO_2—MgO$ in the $CaO—SiO_2—MgO—Al_2O_3$ system at a $Al_2O_3$ concentration of 25 wt. %, preferably the slag comprises CaO in a range of 35-60 wt. % and $SiO_2$ in a range of 10-25 wt. %. More preferably, the slag comprises CaO in a range of 35-50 wt. % and $SiO_2$ in a range of 15-25 wt. %.

Figure 6:
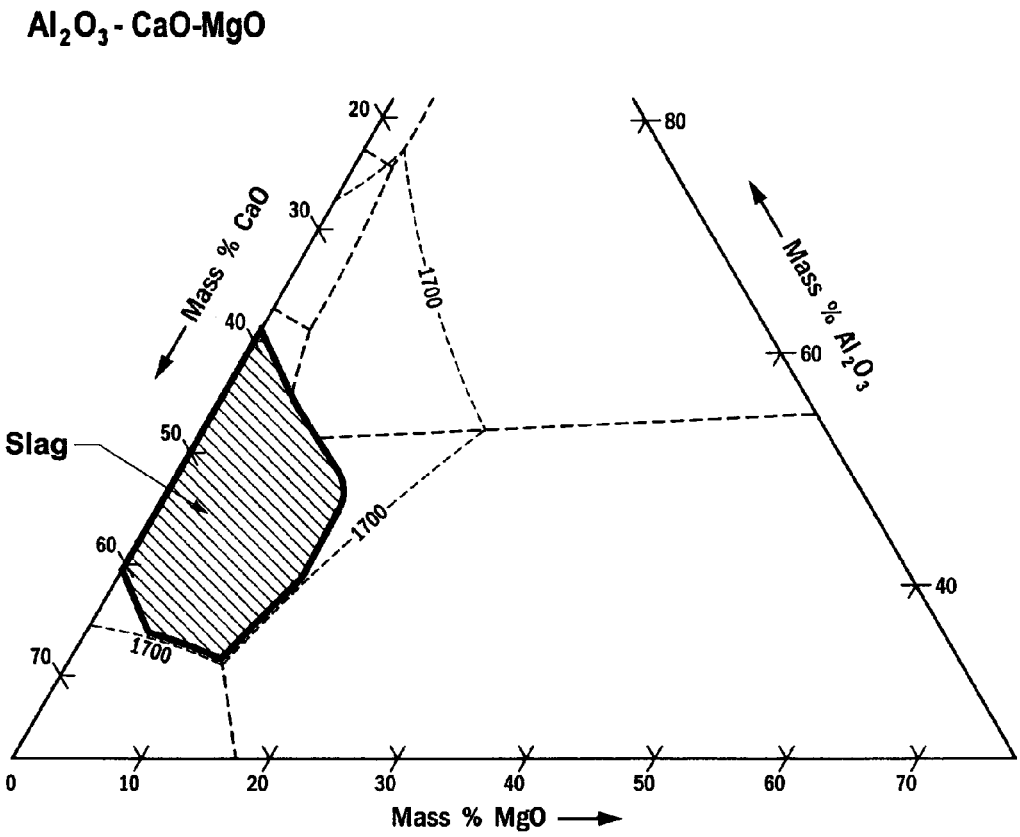
FIG. 6 shows preferred slag compositions in the ternary phase diagram for $Al_2O_3—CaO—MgO$.

FIG. 6 is a ternary phase diagram for $CaO—MgO—Al_2O_3$. The preferred slag composition has an $Al_2O_3$ content of between 35 and 65 wt. %, a CaO content of between 35 and 60 wt. % and up to 15 wt. % MgO. The phase diagram also includes a marked region that identifies a slag composition having a liquidus temperature between 1300 and 1700° C.

The model developed by the applicant is based on a series of heat and mass balances with thermodynamic inputs.

The applicant based the model on and ran the model using the following information:

Production of 25,000 tonnes of nickel per year.

Two different nickel intermediate products in the form of nickel iron hydroxide products having the compositions set out below, with each product being modelled with two different moisture contents, namely 40 wt. % and 70 wt. %.

The method for each nickel iron hydroxide product comprising the steps of: (a) drying and calcining the product in a diesel-fired or gas-fired kiln to substantially remove water (free water and water of crystallisation) and sulphur from the product, with the calcination temperature being selected to be 1000° C. and (b) smelting the dried and calcined product in an electric arc furnace (EAF) using coke as a reductant and adding slag-forming fluxes and producing molten slag and molten metal in the EAF, with the fluxes and the EAF operating conditions being targeted to: (i) maximise nickel in the molten metal and minimise nickel in the molten slag and an off-gas from the EAF, (ii) maximise sulphur in the molten slag, (iii) maximise magnesium, calcium, and sodium and other contaminants for nickel products in the molten slag, and (iv) provide the molten metal with selected concentrations of carbon, sulphur, silicon and manganese.

One of the two nickel iron hydroxide products modelled was produced by a heap leach/ion exchange process—with the following elements and compounds in wt. %, determined on a dry basis.

| Element | Wt. % | Compound | Wt. % |
|---|---|---|---|
| Al | 0.05 | $MgSO_4$ | 0.77 |
| Ca | 0.20 | $Ca_2SO_4*2H_2O$ | 0.86 |
| Cl | 0.20 | $MgSO_4*7H_2O$ | 35.62 |
| Co | 0.10 | $Al[OH]_3$ | 0.14 |
| Cu | 0.05 | $Co[OH]_2$ | 0.16 |
| Fe | 3.00 | $Cu[OH]_2$ | 0.08 |
| Mg | 4.00 | FeO*OH | 4.77 |
| Mn | 0.10 | $Mg[OH]_2$ | 0.66 |
| Na | 0.02 | $Mn[OH]_2$ | 0.16 |
| Ni | 35.00 | $Ni[OH]_2$ | 55.28 |
| S | 5.00 | $Zn[OH]_2$ | 1.22 |
| Zn | 0.80 | $MgCl_2$ | 0.23 |
| | | NaCl | 0.05 |

The other of the two nickel iron hydroxide products modelled was produced by a soda ash process—with the following elements and compounds in wt. %, determined on a dry basis at 105° C.

| Element | Wt. % | Compound | Wt. % |
|---|---|---|---|
| Ca | 0.10 | $CaSO_4*2H_2O$ | 0.43 |
| Cl | 0.10 | $MgSO_4*H_2O$ | 1.01 |
| Co | 0.05 | $Na_2SO_4*10H_2O$ | 0.25 |
| Cu | 0.05 | $NiSO_4*6H_2O$ | 10.32 |
| Fe | 0.10 | $ZnSO_4*7H_2O$ | 0.04 |
| Mg | 0.10 | $Co[OH]_2$ | 0.08 |
| Mn | 0.05 | $Cu[OH]_2$ | 0.08 |
| Na | 0.10 | FeO*OH | 0.16 |
| Ni | 47.00 | $Mn[OH]_2$ | 0.08 |
| S | 1.50 | $Ni[OH]_2$ | 70.60 |
| Zn | 0.01 | NaCl | 0.16 |

FIGS. 7-10 summarise the compositions of the inputs and outputs to the kiln and the EAF as predicted by the models for the two nickel hydroxide products at the different moisture contents of 40 wt. % and 70 wt. %.

Figure 7:
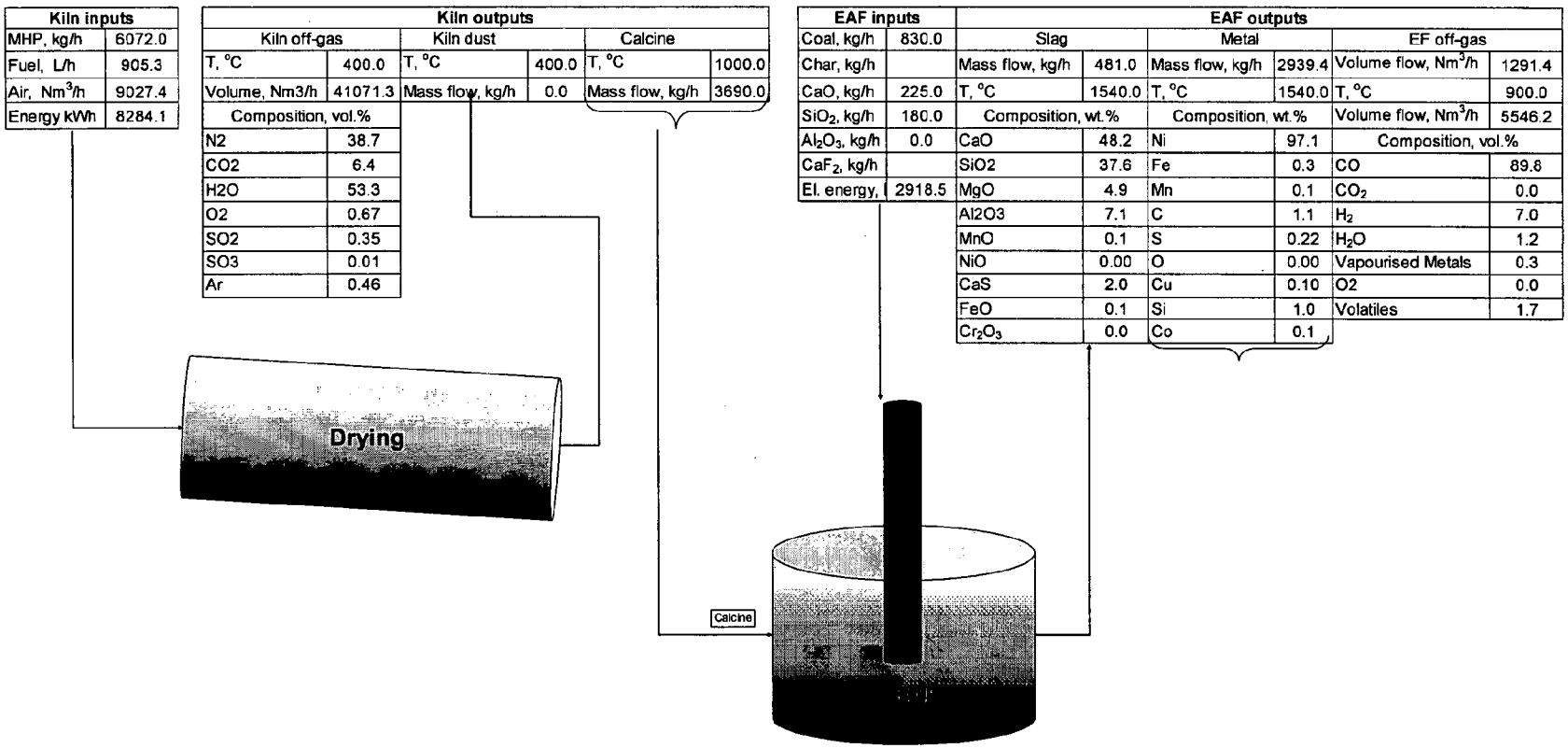
Figure 8:
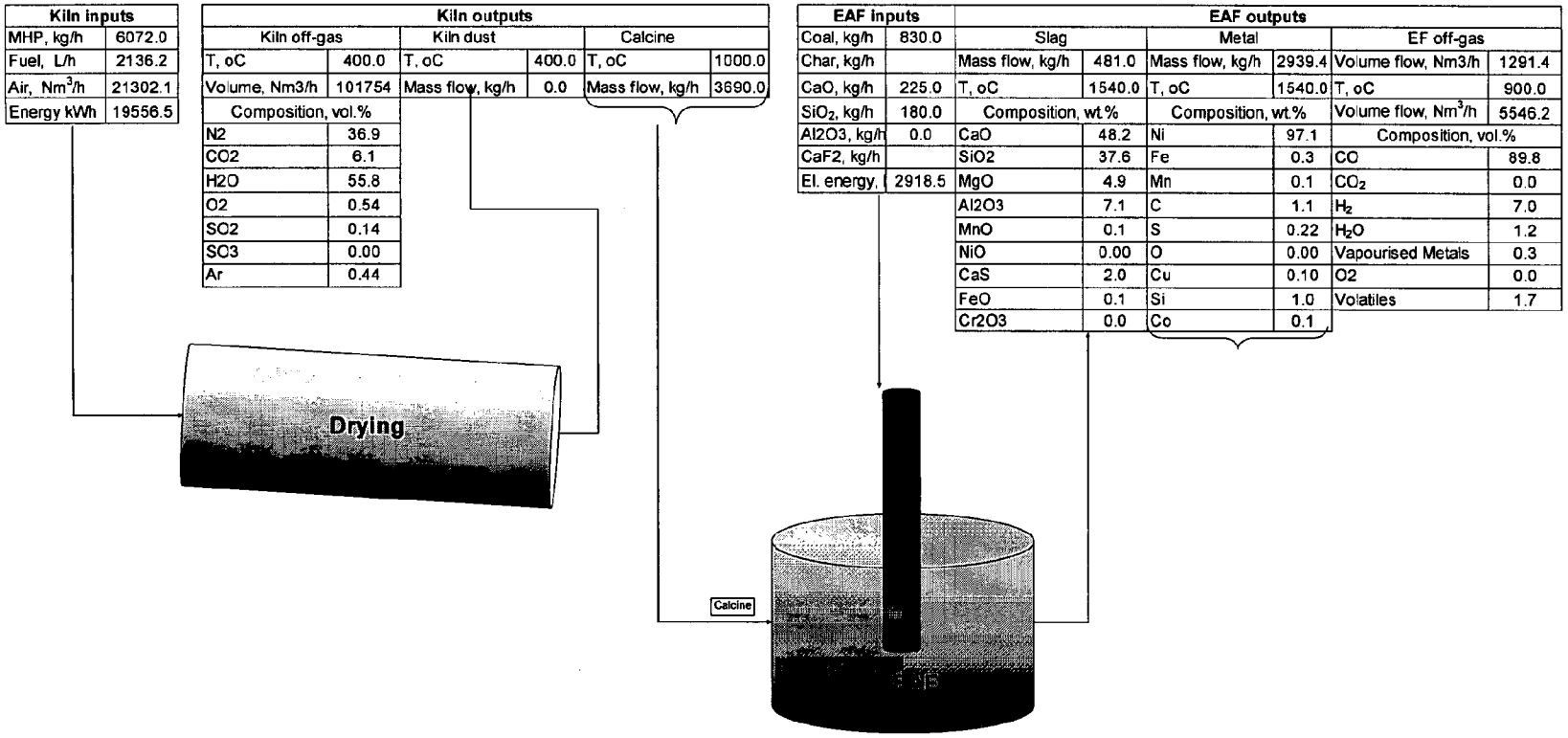

The modelling work found that there were substantial differences between the amounts of energy required to dry and calcine and then smelt the nickel hydroxide products. Energy requirements are a major consideration. Specifically, the models calculated the following energy requirements:

FIG. 7 run—14.1 GJ/tonne of nickel;

FIG. 8 run—28.4 GJ/tonne of nickel;

FIG. 9 run—22.0 GJ/tonne of nickel;

FIG. 10 run—41.1 GJ/tonne of nickel.

It is evident from the inputs and the outputs reported in FIGS. 7-10 and the modelling work generally that the amount of water and the amount of contaminants, such as magnesium and silicon, in the nickel hydroxide products had a major impact on the amount of energy required to produce the target nickel products (i.e. in terms of compositions of the products and maximum recovery of nickel to the products) in each run. In this context, it is relevant to note that there are significant differences in the compositions of the two nickel hydroxide products that were modelled. Specifically, one of the products had much higher concentrations of iron, magnesium, manganese, silicon, sulphur, etc than the other product.

The significant differences in compositions of nickel intermediates, as evident from the above compositions of the two nickel hydroxide products tested, means that a wide range of different slag chemistries are required to optimise partitioning of nickel into molten metal and molten slag across the range of compositions. The required differences in slag chemistry is evident from a comparison of the following slag chemistries for the FIGS. 7/8 runs and the FIGS. 9/10 runs in the modelling work.

| Compound | FIG. 7 run Wt. % | FIG. 8 run Wt. % | FIG. 9 run Wt. % | FIG. 10 run Wt. % |
|---|---|---|---|---|
| CaO | 48.2 | 48.2 | 41.2 | 41.2 |
| $SiO_2$ | 37.6 | 37.6 | 37.4 | 37.4 |
| MgO | 4.9 | 4.9 | 17.2 | 17.2 |
| $Al_2O_3$ | 7.1 | 7.1 | 1.5 | 1.5 |
| MnO | 0.1 | 0.1 | 0.1 | 0.1 |
| NiO | 0.0 | 0.0 | 0.0 | 0.0 |
| CaS | 2.0 | 2.0 | 1.1 | 1.1 |
| FeO | 0.1 | 0.1 | 0.5 | 0.5 |
| $Cr_2O_3$ | 0.0 | 0.0 | 0.0 | 0.0 |

In overall terms, the modelling work indicates that there is considerable scope with the method of the present invention to process nickel hydroxide products having significant variations in composition and water content and to produce nickel products having a wide range of compositions tailored to the requirements of end-use applications.

EXAMPLE

A nickel hydroxide intermediate product was subjected to a smelting operation in which the product, a reductant and a flux were added to a smelter and smelted to produce molten metal and a slag phase. Two flux compositions were used: one (comparative) composition was CaO—$SiO_2$ based and the other composition was CaO—$Al_2O_3$ based.

The slag compositions arising from the two smelting operations are set out in the following table.

| | $SiO_2$ wt. % | CaO wt. % | MgO wt. % | $Al_2O_3$ wt. % | $C_{s2-}$ |
|---|---|---|---|---|---|
| Slag 1 | 44.9 | 40 | 15 | 0.1 | 2.2E−04 |
| Slag 2 | 21.8 | 42.4 | 15.5 | 20.3 | 2.8E−03 |

As is evident, Slag 1 arose from smelting with the CaO—$SiO_2$ based flux and Slag 2 arose from smelting with the CaO—$Al_2O_3$ based flux.

The nickel content in the respective slags is set out in FIG. 11, which plots nickel content in wt % versus the heat number for a number of smelting operations. In Heat numbers 1 to 34, the slag had a composition of Slag 1 and heat numbers 35 to 72 had slag with a composition of Slag 2. As is evident, nickel partitioning into the molten metal phase was better with a slag having a composition of Slag 2.

This Example illustrates the improved nickel recovery using a CaO—$Al_2O_3$ based flux as compared with a CaO—$SiO_2$ based flux. This improvement is believed to be due to a relatively higher reduction rate of NiO in the Slag 2, and the consequent maintenance of lower NiO content in the slag under steady state, leading to both higher productivity and improved recovery of nickel.

Many modifications may be made to the method of the present invention summarised in the Figures and Example and described above without departing from the spirit and scope of the present invention.

By way of example, whilst the above-mentioned work was based on nickel intermediate products in the form of nickel iron hydroxide products, the present invention is not so limited and extends to processing any suitable nickel intermediate products, such as nickel carbonates mentioned above, of any composition and moisture content, and selecting slag compositions that are appropriate for smelting these nickel intermediate products to form required nickel products.

In addition, whilst the above-mentioned work was based on nickel intermediate products in the form of nickel iron hydroxide products having particular compositions and moisture contents, the present invention is not so limited and extends to processing nickel iron hydroxide products of any composition and moisture content and selecting slag compositions that are appropriate for smelting these nickel intermediate products to form required nickel products.

The claims defining the invention are as follows:

1. A method of smelting a nickel hydroxide or nickel carbonate intermediate product in a smelter that contains a molten bath of metal and slag to produce a nickel product, the method comprising supplying the intermediate product and a solid reductant to the smelter; smelting the intermediate product to produce molten nickel; and controlling the chemistry of the slag so that the slag has (a) a solubility for contaminants including magnesium, calcium, cobalt, copper, manganese, silicon, sulfur, phosphorous and/or aluminium in elemental form or as compounds, sufficient to facilitate partitioning of the contaminants into the slag; and (b) a liquidus temperature in the range of about 1300° C. to about 1700° C.

2. The method of claim 1 wherein the slag has a liquidus temperature in the range of about 1400° C. to about 1600° C.

3. The method of claim 1 wherein the slag chemistry is controlled by adding a flux selected from the group consisting of CaO, $Al_2O_3$, $SiO_2$, MgO and mixtures thereof.

4. The method of claim 3 wherein the flux includes CaO and $Al_2O_3$.

5. The method of claim 1, wherein the nickel intermediate product is selected from nickel hydroxide product and nickel carbonate product.

6. The method of claim 5 wherein the nickel hydroxide product is subjected to at least one of drying and calcining prior to supplying it to the smelter, in order to substantially remove free water, water of crystallisation, and any sulphur.

7. The method of claim 6 comprising drying at a temperature of from about 100° C. up to about 120° C.

8. The method of claim 6 comprising calcining at a temperature in the range from about 400° to about 1300° C.

9. The method of claim 6 comprising calcining at a temperature up to 1000° C.

10. The method of claim 1 wherein the slag chemistry is within one of the following pseudo-tertiary, pseudo-quaternary, or pseudo-quinary systems: CaO—MgO—$Al_2O_3$, CaO—$SiO_2$—MgO—$Al_2O_3$ or CaO—$SiO_2$—MgO—$Al_2O_3$—MnO, respectively.

11. The method of claim 10 wherein the $Al_2O_3$ concentration is a maximum of 50 wt.% of the total weight of slag.

12. The method of claim 10, wherein the method comprises controlling the slag chemistry so that the slag basicity, as a ratio of (CaO+MgO):($SiO_2$+$Al_2O_3$) is in the range of about 0.5:1 to about 1.7:1.

13. The method of claim 1, wherein the slag is a CaO—$SiO_2$—MgO —$Al_2O_3$ system including the following composition (wt%):

$Al_2O_3$ 5-25;

CaO 30-60;

$SiO_2$ 10-50.

14. The method of claim 1, wherein the slag is a CaO—$SiO_2$—MgO —$Al_2O_3$ system including the following composition (wt%):

$Al_2O_3$ 5-25

CaO 35-55

$SiO_2$ 15-45.

15. The method of claim 1, wherein the slag is a CaO—MgO—$Al_2O_3$ system including the following composition (wt%):

$Al_2O_3$ 35-65

CaO 35-60

MgO 0-15.

16. The method of claim 1 wherein the method comprises controlling the slag chemistry so that the slag has a sulphide capacity of at least $8\times10^{-4}$.

17. The method of claim 1 wherein the chemistry of the slag is controlled to achieve a redox condition such that up to 1 wt.% of nickel is retained in the slag.

18. The method of claim 1 wherein the nickel intermediate product contains 20-50 wt.% nickel, on a dry basis.

19. The method of claim 1 wherein the nickel intermediate product is a nickel hydroxide product that is produced by hydrometallurgically processing a nickel-containing ore or a concentrate of the ore.

20. The method of claim 1 wherein the iron-containing nickel hydroxide product has a concentration of iron of at least 3 wt.% iron.

21. The method of claim 1 wherein the reductant comprises a carbonaceous material.

22. The method of claim 1 wherein the smelting is conducted in a Stabilised Open Arc Furnace.

23. The method of claim 22 wherein at least one of the nickel intermediate product, the solid reductant, or the flux are supplied to the smelter as fines.

24. The method of claim 1 wherein the method comprises treating an off-gas produced in the smelting step and removing nickel from the off-gas.

* * * * *

UNITED STATES PATENT AND TRADEMARK OFFICE

CERTIFICATE OF CORRECTION

PATENT NO. : 8,460,429 B2
APPLICATION NO. : 12/742828
DATED : June 11, 2013
INVENTOR(S) : Ratchev et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 127 days.

Signed and Sealed this
Eighth Day of September, 2015

Michelle K. Lee

Michelle K. Lee
*Director of the United States Patent and Trademark Office*